US006203037B1

(12) United States Patent
Wilson et al.

(10) Patent No.: US 6,203,037 B1
(45) Date of Patent: Mar. 20, 2001

(54) METAL SPORTS BOARD

(75) Inventors: Ken Wilson, Poway; Christopher Taylor, Cardiff, both of CA (US)

(73) Assignee: Reno Wilson, Inc., Poway, CA (US)

( * ) Notice: Subject to any disclaimer, the term of this patent is extended or adjusted under 35 U.S.C. 154(b) by 0 days.

(21) Appl. No.: 09/206,720

(22) Filed: Dec. 7, 1998

(51) Int. Cl.[7] ..... A63C 17/01
(52) U.S. Cl. ..... 280/87.042
(58) Field of Search ..... 280/11.19, 11.26, 280/87.01, 87.041, 87.042, 842, 609, 610, 14.21, 14.22, 87.021; 441/68, 74; 72/256

(56) References Cited

U.S. PATENT DOCUMENTS

| | | | | |
|---|---|---|---|---|
| 1,552,990 | * | 9/1925 | Hunt | 441/68 |
| 2,926,364 | * | 3/1960 | Cox | 280/610 |
| 3,118,157 | * | 1/1964 | Houser | 280/610 |
| 3,360,277 | * | 12/1967 | Salvo | 280/610 |
| 3,374,495 | * | 3/1968 | Joyce | 441/74 |
| 3,722,900 | * | 3/1973 | Dickert | 280/842 |
| 3,762,734 | * | 10/1973 | Vogel | 280/610 |
| 4,076,265 | * | 2/1978 | Eash, II | 280/87.042 |
| 4,161,326 | | 7/1979 | Gaber . | |
| 4,182,520 | | 1/1980 | Stevenson . | |
| 4,196,916 | * | 4/1980 | Schorr | 280/87.042 |
| 4,234,204 | * | 11/1980 | Tibbals | 280/87.042 |
| 4,337,963 | | 7/1982 | Stevenson . | |
| 4,458,907 | | 7/1984 | Meredith . | |
| 4,887,824 | * | 12/1989 | Zatlin | 280/87.042 |
| 4,897,063 | | 1/1990 | Scheurer et al. . | |
| 5,029,661 | * | 7/1991 | Wallace et al. | 280/87.042 |
| 5,236,208 | * | 8/1993 | Welsh | 280/87.041 |
| 5,249,819 | * | 10/1993 | Mayr | 280/609 |
| 5,267,743 | | 12/1993 | Smisek . | |
| 5,299,822 | * | 4/1994 | Mayr et al. | 280/609 |
| 5,312,258 | * | 5/1994 | Giorgio | 280/14.2 |
| 5,487,441 | * | 1/1996 | Endo et al. | 280/87.042 |
| 5,924,718 | * | 7/1999 | Gordon et al. | 280/610 |

FOREIGN PATENT DOCUMENTS

| | | | | |
|---|---|---|---|---|
| 169739 | * | 8/1934 | (CH) | 280/842 |
| 84816 | * | 3/1965 | (FR) | 280/610 |
| 494087 | * | 5/1954 | (IT) | 280/609 |

* cited by examiner

*Primary Examiner*—Frank Vanaman
(74) *Attorney, Agent, or Firm*—Lyon & Lyon LLP

(57) ABSTRACT

A sports board that is ridden by a person standing upon it. The board is formed of extruded metal and it has an extruded hollow keel formed in its bottom surface that extends from its front end to its rear end. The height of the keel is much smaller than its width and it has a substantially rectangular cross-sectional configuration. An extruded hollow left rail and an extruded hollow right rail are formed on the bottom surface of the metal board adjacent its respective left and right edges and they extend the length of the metal board. Plastic end guards are secured to the front and rear ends of the metal board. In one embodiment of the sports board, front and rear skateboard trucks are secured to the bottom surface of the metal board.

9 Claims, 2 Drawing Sheets

METAL SPORTS BOARD

BACKGROUND OF THE INVENTION

The invention relates to sport boards that are ridden by a person standing upon them, and more specifically to one whose basic structure is an elongated extruded metal board. Some examples of sport boards are skateboards, snowboards and wakeboards.

The earliest skateboards were made of a plain flat piece of wood. Later models were made of other materials and had improved structure. The Gaber U.S. Pat. No. 4,161,326 discloses an improved skateboard having a replaceable arc-tail with a wear surface and further having wheel wells.

The Stevenson U.S. Pat. No. 4,182,520 discloses a skateboard structure having a central platform formed of a top piece and a bottom piece. The two pieces may be shaped to define an inner surface of cellular configuration so that when the two pieces are fitted together they define an internal reinforcing honeycomb-like core. The Stevenson U.S. Pat. No. 4,337,963 discloses the top and bottom pieces being formed of appropriate injection molded plastic material, such as polypropylene, polyethylene, polycarbonate, Plexiglass, or other plastic material which is susceptible to injection molding; or aluminum casting or compression molded fiberglass; or any other material which may be molded or cast.

The Meredith U.S. Pat. No. 4,458,907 discloses a skateboard having a front member and a rear member and structure for allowing the length of the skateboard to be extended or retracted.

The Scheurer et al U.S. Pat. No. 4,897,063 discloses a reaction injection molded recreation board with spaced rectangular reinforcing rods. The rods are rectangular in cross section and are disposed between upper and lower surfaces of the board.

The Smisek U.S. Pat. No. 5,267,734 discloses a hollow elongated board having openings, formed in the underside of the board, adapted to receive standard skateboard wheels. The skateboard further employs wheel ramps on opposite sides of each wheel to provide a smooth under surface to aid in negotiation of large obstacles such as curbs, stairs, etc. and to allow the skateboard to glide over smaller objects.

In the late 1970's, an American skateboard manufacturer made his boards of aluminum plate material. These boards proved to be too heavy and too expensive and were not very popular. The edges of the skateboard, after heavy use, became razor blade sharp and were extremely dangerous.

The inventors recognized the problems of the prior art aluminum metal skateboards when they attempted to make the skateboards out of flat sheet aluminum. The flat sheet metal bent in the middle and could not endure hard riding. It was then decided to go with a thicker piece of aluminum and cutout sections of the metal to make it lighter while still maintaining sufficient structural support. The problem of razor sharp edges still occurred with the metal board and the metal board was still too heavy. Additionally, it also bent or buckled in the middle of the board when it was subjected to hard use.

It is an object of the invention to provide a novel metal board that is lightweight yet capable of withstanding the hard use of jumping actions by the rider and not bend or break.

It is another object of the invention to provide an extruded metal board that could be used as a sport board that is ridden by a person standing upon it.

It is also an object of the invention to provide a novel metal board whose left and right edges have extruded hollow rails that are not subject to be coming razor blade sharp.

It is an additional object of the invention to provide a novel metal board that could be used in multiple sports such as skateboarding, wakeboarding and snowboarding.

It is a further object of the invention to provide a novel metal board that is economical to manufacture and market.

SUMMARY OF THE INVENTION

The novel sports board has been designed to be formed of extruded metal thereby allowing it to be formed as thin as possible by incorporating extruded hollow rails along its left and right edges and a hollow keel along its bottom surface. The strength of the respective hollow rails and hollow keel allow the sport board to be ridden hard without worrying about the board bending or breaking. A preferred embodiment of the metal board is made of 6000 series T-6 aircraft aluminum. Different aluminum or titanium may be used depending upon the physical properties desired such as tensile strength, yield strength, weight, etc.

The use of the sports board as a skate board subjects it to tremendous forces when the rider is performing jumps. For instance, a 200 pound rider that jumps from a height of 3 feet and absorbs the impact by bending his knees 3.6 inches subjects the skateboard to a force of 2000 pounds. A jump from a height of 6 feet produces a force of 4000 lbs. These forces will break wooden and flat plate metal skateboards.

Static tests for different aluminum boards for skateboards produced the following data:

| Weight | Deflection |
|---|---|
| For a flat plate board .100 inch thick (without rails) | |
| 200 lbs. | 1.07 inch |
| 250 lbs. | 1.34 inch |
| For a flat plate board .1875 inch thick (without rails) | |
| 200 lbs. | .162 inch |
| 250 lbs. | .203 inch |

For a board according to the inventors design with a plate 0.100 inches thick and with the two rails 0.500 inches high and 0.625 inches wide with walls having a thickness of 0.0625 inches.

| Weight | Definition |
|---|---|
| 200 lbs. | .048 inches |
| 250 lbs. | .060 inches |
| 1000 lbs. | .240 inches |

The weight of the hollow rail design above was well below 2.6 pounds. The weight of the board is thus lighter than either a wooden board or an aluminum plate board and much stronger than either of them.

The method of manufacturing the novel sports board comprises the first step of extruding an elongated metal board with a longitudinally extending hollow keel formed on its bottom surface and a hollow left rail and a hollow right rail formed on its bottom surface adjacent the left and right edges. Typically the board then has its front and rear tips bent upwardly at a predetermined angle. This metal board is then subjected to a heat treating process to reduce stresses formed in the metal board during the extrusion and bending operations. This basic structure can then be utilized as the basic component for sport boards such as skateboards, wakeboards and snowboards.

DESCRIPTION OF THE PREFERRED EMBODIMENT

Figure 1:
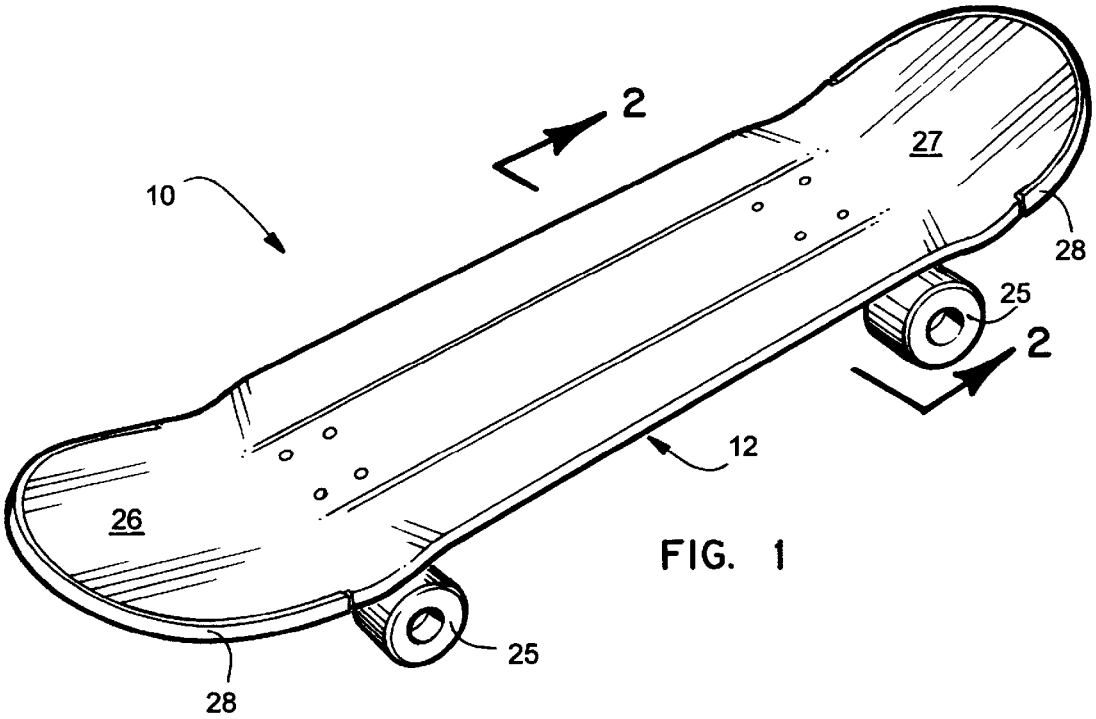
FIG. 1 is a front perspective view of the novel extruded metal board utilized as a skateboard.
Figure 2:
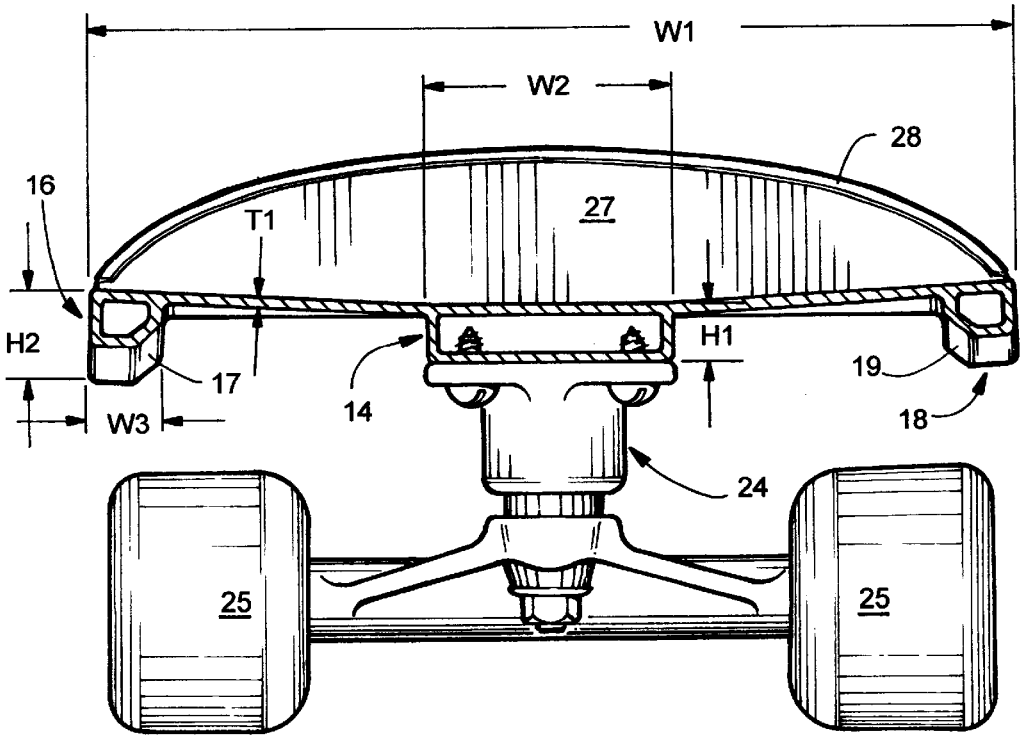
FIG. 2 is a cross sectional view taken along lines 2—2 of FIG. 1.
Figure 3:
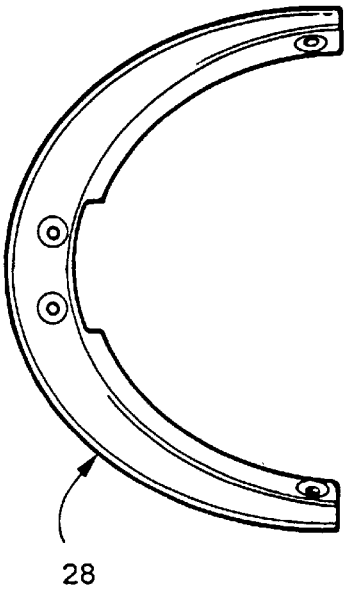
FIG. 3 is a bottom plan view of one of the plastic end guards for the extruded metal board.

The novel extruded metal board will now be described by referring to FIGS. 1–6 of the drawings. The sport board designated numeral 10 is a skateboard and its major component is elongated extruded metal board 12.

Extruded metal board 12 has a length L1 in the range of 24–60 inches and a width W1 in the range of 5–12 inches. Its surface has a concave transverse contour. An extruded hollow keel 14 is substantially rectangular in shape and it has a height H1 in the range of 0.200–0.800 inches and a width W2 in the range of 0.500–3.000 inches. An extruded hollow left rail 16 and an extruded hollow right rail 18 are formed on the bottom surface of the metal board 12. The inner upright walls 17 and 19 of the respective rails are inclined to allow clearance space for the wheels when the rider weights the metal board heavily to a particular side edge. The rails have a height H2 in the range of 0.200–0.800 inches and a width W3 in the range of 0.300–1.00 inches. The thickness T1 of the metal board is in the range of 0.050–0.250 inches.

A pair of skateboard trucks 24 are secured to the bottom surface of metal board 12. Each truck has a pair of wheels 25. The front and rear ends of metal board 12 have upwardly inclined tip portions 26 and 27. The front and rear ends of the respective tip portions have an arcuate configuration. guards 28 are secured to the respective tip portions.

Figure 4:
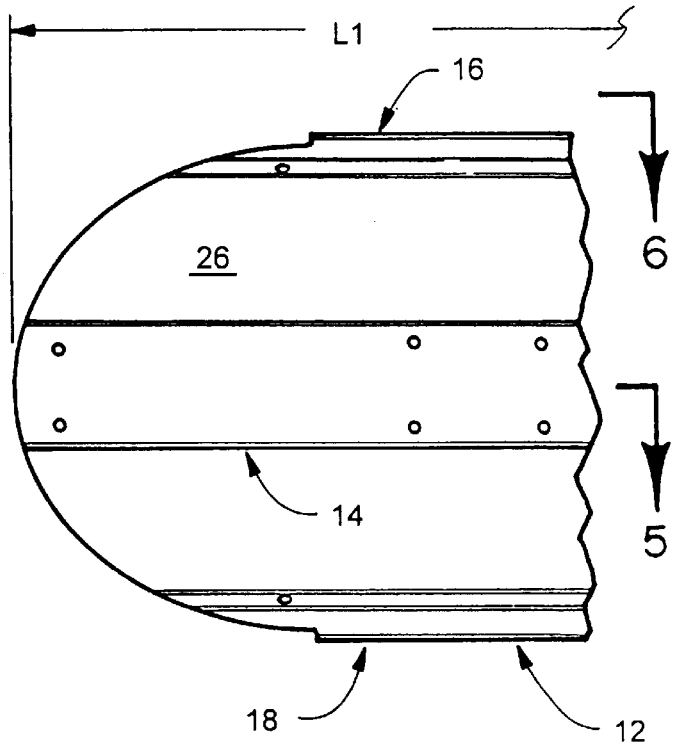
FIG. 4 is a partial bottom plan view of one end of the extruded metal board.
Figure 5:
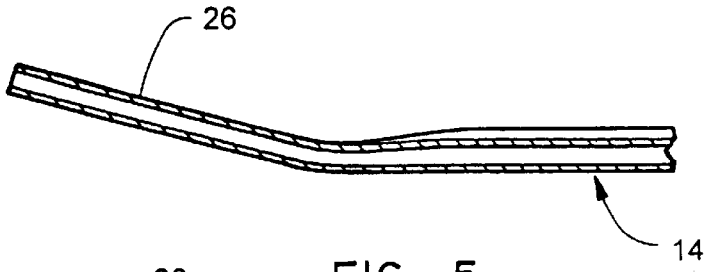
FIG. 5 is a cross sectional view taken along lines 5—5 of FIG. 4.
Figure 6:
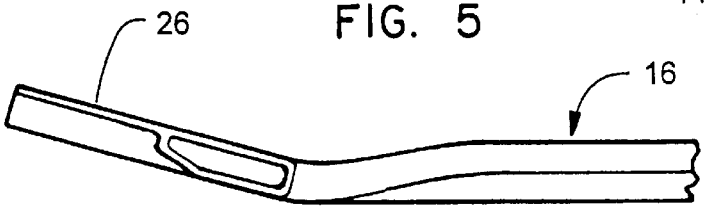
FIG. 6 is a side elevation view taken along lines 6—6 of FIG. 4.

FIG. 4 is a partial bottom plan view of one end of the metal board 12 and its other end is substantially identical. FIG. 5 is a cross sectional view taken along lines 5—5 of FIG. 4 and FIG. 6 is a side elevation view taken along lines 6—6 of FIG. 4 of the front end of the metal board.

What is claimed is:

1. A skateboard that is adapted to be ridden by a user standing upon it, comprising: an elongated extruded aluminum metal board; said metal board having a front end, a rear end, a top surface, a bottom surface, a left edge, a right edge, and a width adapted to accommodate the user's feet in a direction generally perpendicular to the longitudinal axis of the board; a keel located between said bottom surface and said top surface of said metal board and defined by a continuous, closed cavity forming member extending substantially the length of the board; said keel having a height H1 and a width W2 and W2 is greater than H1; and a left rail and a right rail located between said bottom surface and said top surface adjacent said respective left and right edges and said rails defined by respective continuous, closed cavity forming members extending substantially the length of said metal board.

2. A skateboard as recited in claim 1 wherein said keel has a substantially rectangular cross-sectional configuration.

3. A skateboard as recited in claim 1 wherein said metal board has an arcuate shaped front end and an arcuate shaped rear end.

4. A skateboard as recited in claim 3 wherein plastic end guards are secured to said front and rear ends of said metal board.

5. A skateboard as recited in claim 1 wherein said top surface of said metal board has a concave transverse contour.

6. A skateboard as recited in claim 1 wherein said metal board has a bent-up front tip portion and a bent-up rear tip portion.

7. A skateboard as recited in claim 1 further comprising front and rear skateboard trucks secured to said bottom surface of said metal board.

8. A skateboard as recited in claim 1, wherein said board deflects less than 0.162 in. with a load of 200 lbs.

9. A skateboard as recited in claim 1, wherein said board deflects less than 0.203 in. with a load of 250 lbs.

* * * * *